US005577927A

United States Patent [19]

Okada et al.

[11] Patent Number: 5,577,927

[45] Date of Patent: Nov. 26, 1996

[54] ELECTRICAL TERMINAL

[75] Inventors: Naohisa Okada; Hitoshi Okumura, both of Yokkaichi, Japan

[73] Assignee: Sumitomo Wiring Systems, Ltd., Japan

[21] Appl. No.: 353,363

[22] Filed: Dec. 2, 1994

[30] Foreign Application Priority Data

Dec. 10, 1993 [JP] Japan ..... 5-071845 U

[51] Int. Cl.[6] ..... H01R 13/28

[52] U.S. Cl. ..... 439/287; 439/907

[58] Field of Search ..... 439/868, 859, 439/883, 889, 907, 287, 288

[56] References Cited

U.S. PATENT DOCUMENTS

| | | | |
|---|---|---|---|
| 1,874,593 | 8/1932 | Olson . | |
| 3,316,522 | 4/1967 | Demler, Sr. | 439/288 OR |
| 4,273,401 | 6/1981 | Katzin | 439/889 X |
| 4,357,070 | 11/1982 | Fukushima et al. | 439/287 X |
| 4,371,230 | 2/1983 | Inoue | 439/907 X |
| 5,188,544 | 2/1993 | Mukai | 439/907 X |

FOREIGN PATENT DOCUMENTS

| | | |
|---|---|---|
| 58-26171 | 2/1983 | Japan . |
| 63-28536 | 8/1988 | Japan . |

*Primary Examiner*—Khiem Nguyen
*Assistant Examiner*—Daniel Wittels
*Attorney, Agent, or Firm*—Banner & Witcoff, Ltd.

[57] ABSTRACT

Electrical terminals having the same shape are provided and which can be integrated. Two latch flanges 7 are provided projecting in symmetrical positions on the circumference of an eye-shaped connection region 5, and hook portions 10 into which the companion latch flanges 7 enter are formed in positions adjacent to the latch flanges 7 to the rear in the clockwise direction. Projections 12 are formed by shearing the surface of the connection region 5 upwards, inwards from the latch flanges 7, and to the front of these are formed lock holes into which the companion projections 12 fit. The connection region 5 of one terminal 1 is laid over the top surface of the connection region 5 of another terminal 1 concentrically, then the upper terminal is turned clockwise, whereupon the latch flanges 7 engage into the companion hooks 10; the projection 12 of the lower terminal 1 fits in the companion lock hole 13 so that the two terminals 1 are integrated.

16 Claims, 5 Drawing Sheets

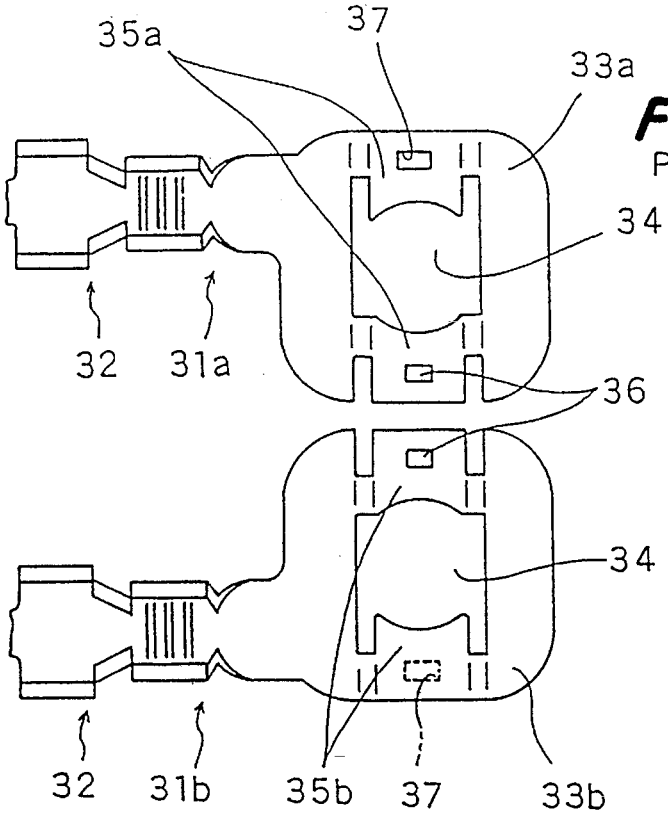
FIG. 11
PRIOR ART
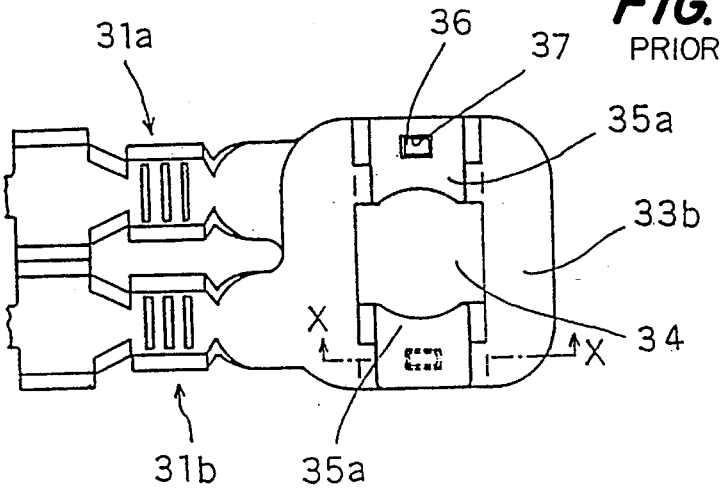
FIG. 12
PRIOR ART
FIG. 13
PRIOR ART
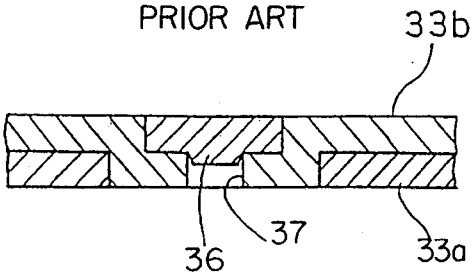

ELECTRICAL TERMINAL

FIELD OF THE INVENTION

The present invention relates to an electrical terminal and particularly to terminal which is adapted to be integrated with other similar terminals prior to attachment of an integrated terminal assembly to a connection stud of an apparatus.

BACKGROUND OF THE INVENTION

Electrical terminals of this kind are provided when for example, the earth wires in a wire harness of an automobile are to be connected to an earth stud or bolt provided on the vehicle body. It is known to integrate the terminals in advance so that the attachment to the stud is managed in a single act. This improves working efficiency since the terminals do not have to be placed individually onto the earth stud or bolt. The integrated assembly also ensures that the wire connection portions are arranged in a predetermined manner to avoid undesirable overlapping or fouling of adjacent vehicle body structure.

In particular left and right handed terminals are known which can be integrated in advance, but this design is disadvantageous since terminals of different shape are required. As a consequence costs are increased since two such handed terminals must be manufactured and stocked, and the possibility of error is introduced since the wrong terminal may be inadvertently selected for attachment to a wire.

SUMMARY OF THE INVENTION

Thus, the present design aims to provide terminals of the same shape which can be assembled together and integrated.

According to the present invention there is provided an electrical terminal provided with a connection region having an aperture therein and an arm to which the end of an electrical wire is connected in use, the terminal being characterised by angularly spaced male and female latching members formed in the connection region, the male latching member being engageable with the female latching member of an overlying second of said terminals on relative angular movement therebetween, and said connection region further including a projection extending out of the plane thereof and an angularly spaced and corresponding lock aperture, a projection and lock aperture of first and second overlying terminals being engageable on engagement of said latching members.

Preferably the male latching member has a tapered nose to ensure smooth engagement in the female latching member.

In a preferred embodiment the projection is radially inward of the male latching member, and is preferably disposed in the clamping region of the connection region.

The projection may be sheared outwardly of the plane of the connection region so that it protrudes upwardly in use.

The female latching member may be constituted by a radially outwardly extending arm of the connection region which is bent over to define a substantially C shaped opening for the male latching member.

In a preferred embodiment the terminal includes two opposite male latching members and two opposite female latching members. The terminal may include two opposite projections and two opposite lock apertures.

One of the male and female latching members may include a projection to engage the other of the latching members in use. Such a projection ensures tight engagement of the members and is preferably formed on the male latching member.

In use the connection portion of a terminal according to the invention is overlaid on the upper surface of the connection portion of another terminal with their apertures concentrically aligned, and the terminal pieces are turned in relation to each other; the female latching member of the one terminal engages with the male latching member of the other terminal, and the projections of the one terminal fit into the lock apertures of the other terminal, thereby integrating the two terminals. The integrated terminal assembly is secured by placing it over a stud projecting from a base structure.

Because the projections are preferably formed by shearing upwardly, the whole of the seating surface of a nut can be secured fast against the connection region as the projections are depressed when the nut is tightened, and a good, secure electrical connection is thereby achieved.

The tapered nose of the male latching member guides it smoothly into the female latching member, and the integrating operation is performed more easily.

In other words, because identically shaped terminal pieces of only one type are provided according to the present invention, it follows that not only can the said terminal pieces be produced with a single machine, but also supervision and the like become easier, and costs can be brought down substantially due to such aspects as the work of connecting electrical wires being carried out on a common line using common parts.

BRIEF DESCRIPTION OF THE DRAWINGS

Other features of the invention will be apparent from the following description of preferred embodiments illustrated by way of example only with reference to the accompanying drawings in which:

FIG. 11 is a plan view of a conventional terminal piece;

FIG. 12 is a plan view of conventional terminals in the integrated state;

FIG. 13 is a cross-section along the line X—X in FIG. 12.

DETAILED DESCRIPTION OF THE PREFERRED EMBODIMENTS

Figure 1:
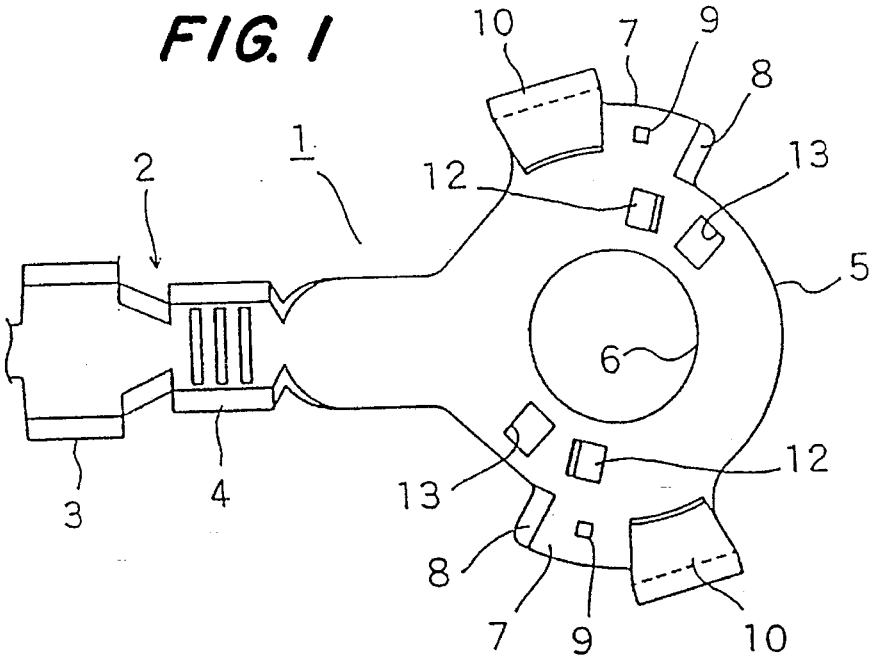
FIG. 1 is a plan view of the terminal according to a first embodiment of the invention.

The terminals shown in FIGS. 11, 12 and 13 are of a known type. This integrated terminal assembly comprises a pair of two types of terminals 31*a* and 31*b*. In each of the terminals 31*a* and 31*b*, connection regions 33*a* and 33*b* are provided having earth stud insertion holes 34. The terminals have barrel-like head regions 32 to be fixed to the ends of wires. The regions 33*a* and 33*b* bulge outwardly on opposite sides as illustrated. Attachment pieces 35*a* rise from the plane of one of the terminals by about the thickness of the terminal, and are formed to the left and right of the insertion hole 34. Attachment pieces 35*b* sink below the plane of the other terminal, by about the thickness of the terminal, and are formed to the left and right of the insertion hole 34. Projections 36 are formed in the under surface of the attachment piece 35*a* on the side of the bulging portion and on the top surface of the attachment piece 35*b* on the side of the bulging portion. Corresponding lock holes 37, into which the above-mentioned projections 36 can fit are formed oppositely in the other attachment pieces.

In use, the connection region 33*b* of the terminal piece 31*b* on which are formed the sunken attachment pieces 35*b* is placed over the top surface of the connection region 33*a* of the terminal piece 31*a* on which are formed the rising attachment pieces 35*a;* the attachment pieces 35*b* disappear under the companion attachment pieces 35*a,* and, as shown in FIG. 12 and FIG. 13, the two terminal pieces 31*a* and 31*b* are integrated when the projections 36 fit into the corresponding lock holes 37.

Figure 4:
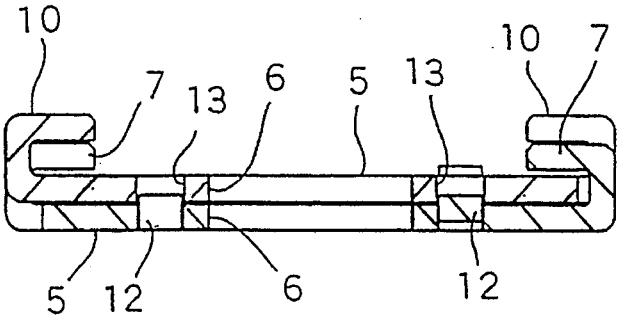
FIG. 4 is a cross-section along the line IV—IV in FIG. 3.
Figure 5:
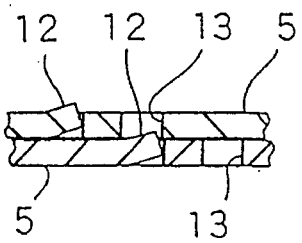
FIG. 5 is a cross-section along the line V—V in FIG. 3.
Figure 6:
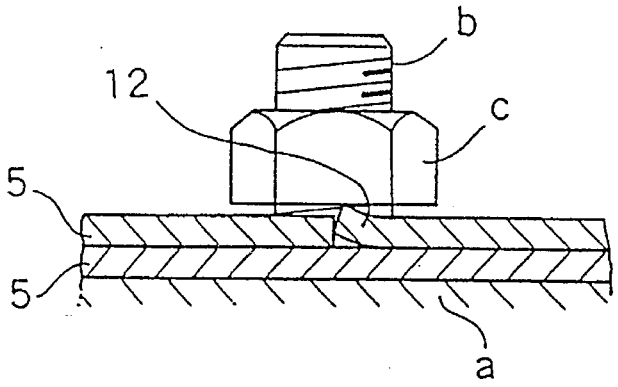
FIG. 6 is an enlarged cross-section during the tightening of a securing nut.

FIG. 1 to FIG. 7 show a first embodiment of the present invention. As shown in FIG. 1, the terminal 1 has an annular connection region 5, at the head of a barrel region 2 on which are formed an insulation clamping barrel 3 and a wire clamping barrel 4 which respectively clench and fix the end of the covering of the wire and the core wire projecting from this end. An insertion hole 6 is provided in the centre of the connection regions. As shown in FIG. 6 the connection region 5 is intended to be fixed over an earthing stud or bolt b projecting from the body a of an automobile for example.

Two wing-shaped male latch pieces 7 are provided projecting from the circumference of the connection region 5 in symmetrical positions at points 180° apart. The top surfaces 8 at the nose of the latch pieces 7 in the clockwise direction slope gradually towards the end. Projections 9 are formed by punching up in the top surfaces of the latch pieces 7.

Latch piece-receiving female parts 10 into which the male latch pieces 7 of a companion terminal piece 1 can be fitted from the side are formed in positions adjacent to the latch pieces 7 in the anticlockwise direction, this being achieved by extending the ring connection region 5 outwards and folding the extended end inwards with a predetermined space between it and the top surface of the connection region 5.

Projections 12, of which the front edges in the clockwise direction have been sheared upwardly as shown in FIG. 6, are formed in positions inward from the latch pieces 7 in the area on the top surface of the connection region 5 corresponding to the seating surface of a nut c screwed on to an earthing stud b in use. In addition, lock holes 13 into which the projections 12 of the companion terminal piece 1 fit are formed in positions a predetermined distance in front of the projections 12 in the clockwise direction.

Integration is performed in the following manner. Firstly, as shown in FIG. 2, the connection region 5 of one terminal 1 is laid over the top surface of the connection region 5 of another terminal 1 with their insertion holes 6 aligned concentrically and positioned such that the latch pieces 7 of the upper terminal 1 are positioned counter-clockwise to the latch piece-receiving parts 10 of the lower terminal 1.

Figure 2:
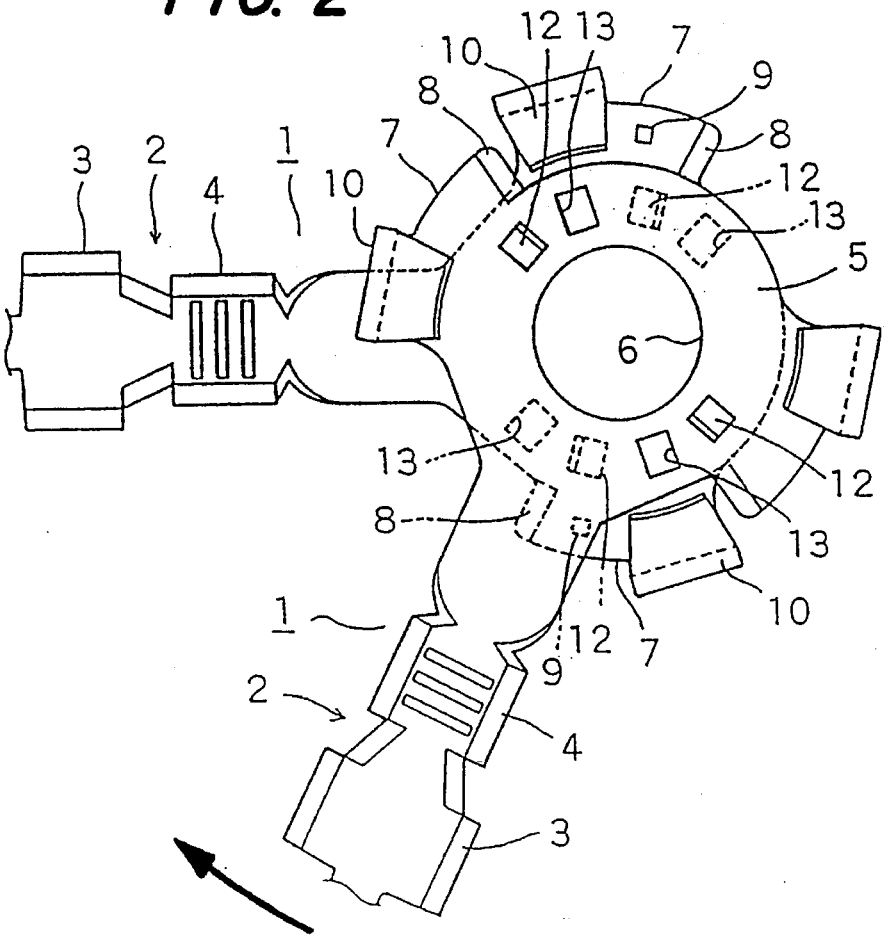
FIG. 2 is a plan view of two terminals overlaid one on the other.

Next, the connection region 5 of the upper terminal 1 is turned in the direction of the arrow in FIG. 2 (the clockwise direction), being pressed against the lower connection piece 5 while overcoming the resilient forces to depress the projections 12 formed in the top surface of the lower connection region 5, whereupon the male latch pieces 7 of the upper terminal 1 enter into the female latch-receiving parts 10 of the lower terminal 1 to the front (see FIG. 4). At this time, because the top surfaces 8 at the front of the latch pieces 7 in the direction of turning are downwardly sloped, they enter smoothly into the companion latch-receiving parts 10. Furthermore, because projections 9 are formed in the top surfaces of the male latch pieces 7, they are urged strongly into the female latch-receiving parts 10.

Figure 3:
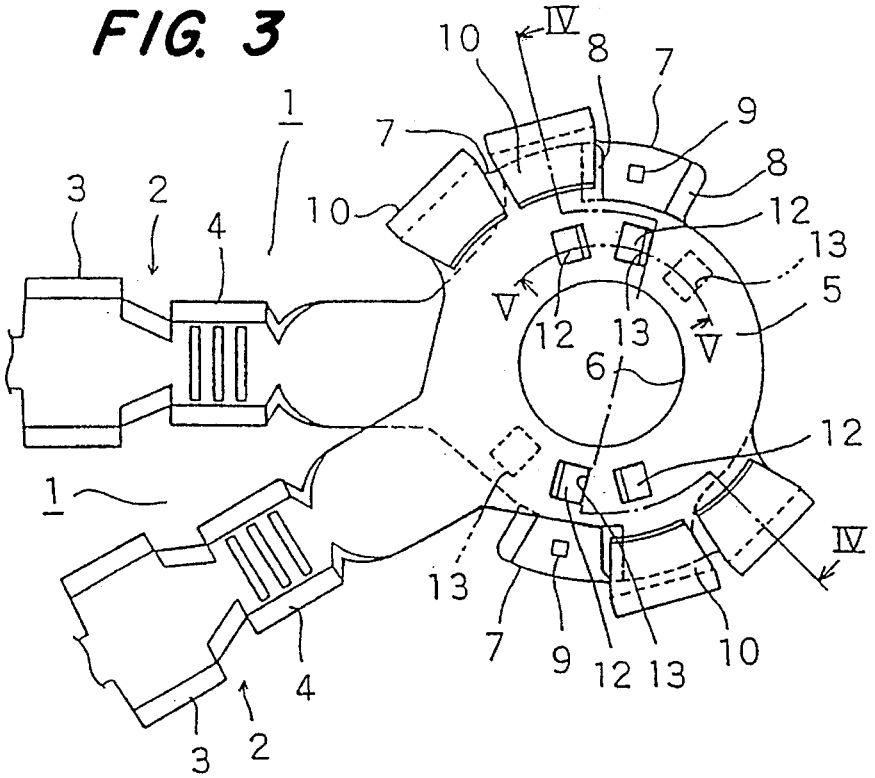
FIG. 3 is a plan view of the two terminals in the integrated state.

As shown in FIG. 3, the latch pieces 7 enter into the latch receiving parts 10 across the whole of their width and are engaged, whereupon the lock hole 13 of the upper terminal 1 corresponds to the position of the projection 12 of the lower terminal 1; the projection 12 springs up under the resilient restoring force and fits into the lock hole 13 (see FIG. 5).

In this state, the latch pieces 7 of the upper terminal piece 1 fit into the latch-receiving parts 10 of the lower terminal 1, thereby preventing the connection regions 5 from shifting in the direction in which they would come part. Further, the upstanding front edge of the projection 12 latches with the side edge of the lock hole 13 of the companion terminal piece 1, (see FIG. 5), and the front edge of the latch-receiving part 10 of the upper terminal 1 in the clockwise direction latches with the rear edge of the latch-receiving part 10 of the lower terminal 1 in the clockwise direction, thereby preventing turning movements in either direction; thus the two terminals 1 are integrally linked.

The two terminals 1 which have been integrated in this way are attached and electrically connected in use to an appliance by inserting a stud or bolt b, which is provided projecting in the connection region a of the appliance, through the insertion holes 6 of the said terminal pieces 1, screwing a nut c onto the end of the said bolt b and tightening. In other words, the operation of inserting the stud bolt b is completed in one operation.

Figure 7:
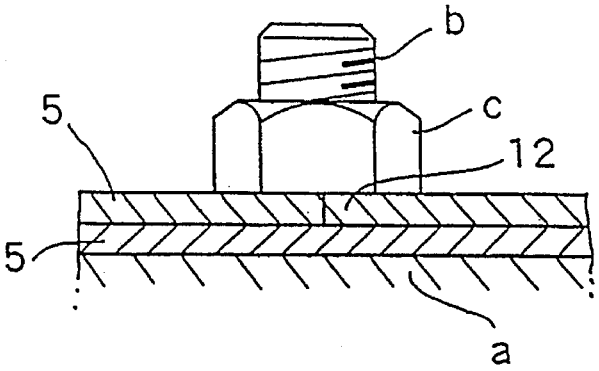
FIG. 7 is an enlarged cross-section after the tightening of the nut has been completed.

Moreover, in this case, as shown in FIG. 6, the projections 12 projecting from the top surface of the connection region 5 of the upper terminal 1 abut against the seating surface of the nut c, but because the projections 12 are formed by shearing up, the projection 12 is depressed against its resilient force as the nut c is tightened. As shown in FIG. 7, the whole of the seating surface of the nut 2 is fast against the connection region 5 of the upper terminal piece to guarantee a good electrical connection.

Figure 9:
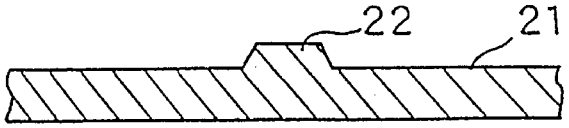
FIG. 9 is a partial cross-section showing the form of a projection thereof.
Figure 8:
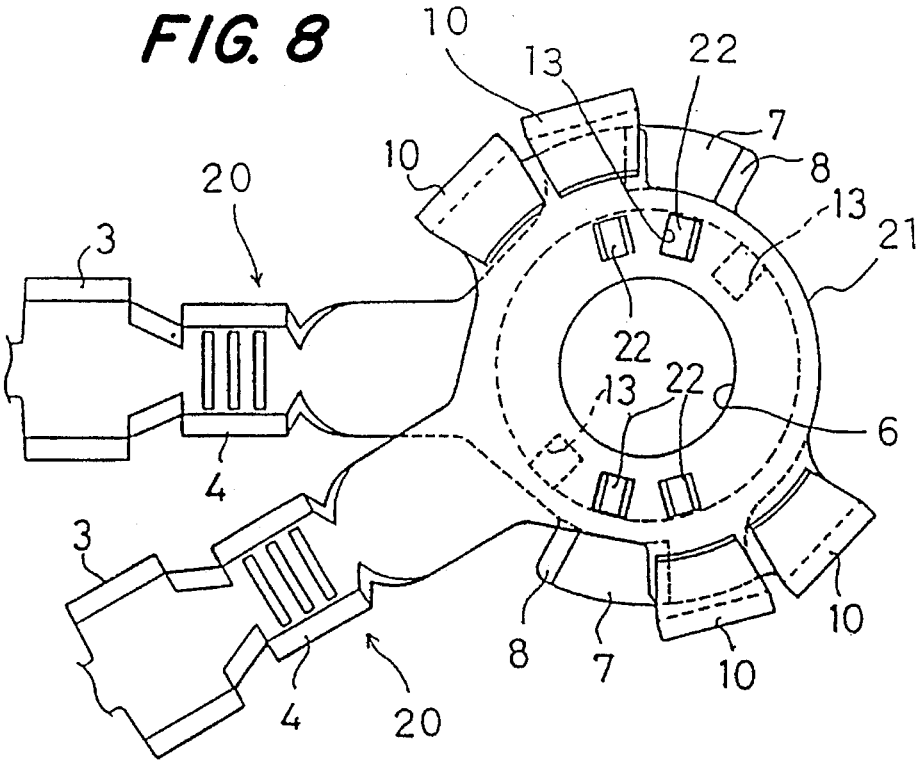
FIG. 8 is a plan view of two terminals of a second embodiment of the invention in the integrated state.

FIG. 8 and FIG. 9 show a second embodiment of the present invention. Instead of a projection 12 being formed by an upwards shear (as in the first embodiment described above) a projection 22 is formed in the terminal piece 20 in the present embodiment by elevating the top surface of the connection region 21. This alternative embodiment is similar to the first embodiment and identical parts have been given identical references and further description has been omitted. In this second embodiment, identically shaped terminal pieces 20 of only one type may be provided. The projection 22 engages a corresponding lock hole 13 in use.

Figure 10:
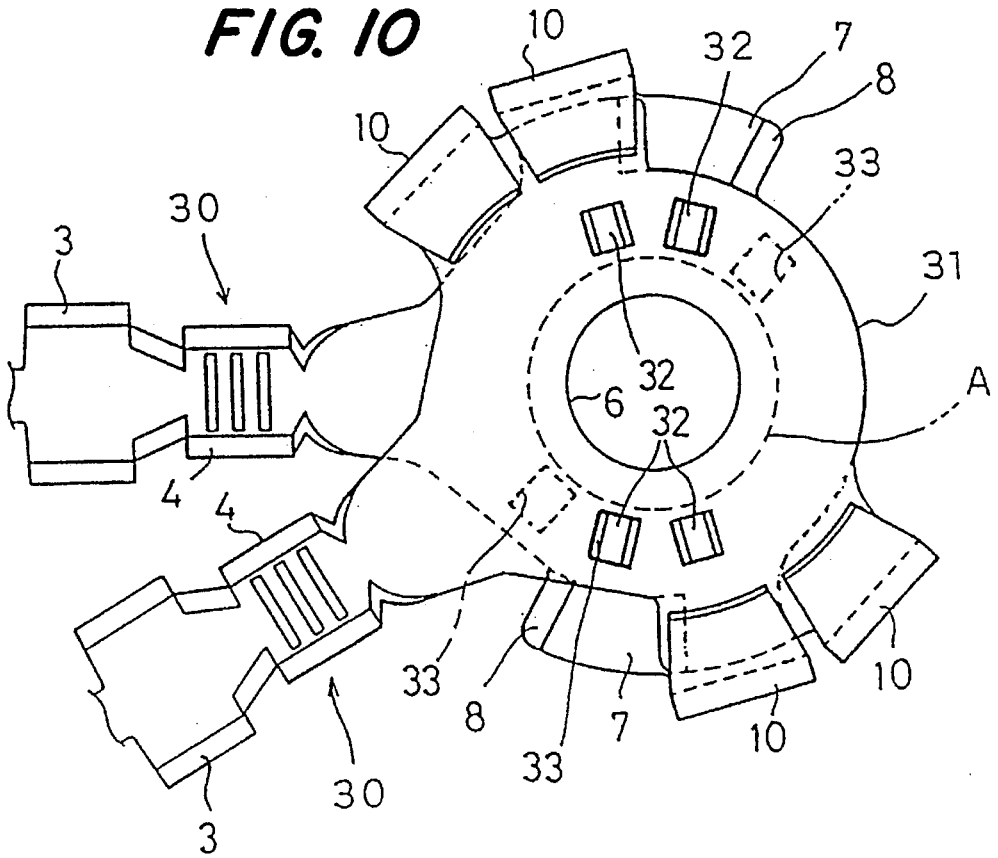
FIG. 10 is a plan view of two terminal pieces of a third embodiment in the integrated state.

FIG. 10 shows a third embodiment, in which the connection region 31 in the terminal piece 30 has a larger diameter than in the second embodiment, and projections 32 of elevated shape as in the second embodiment, and lock holes 33 into which the projections 32 of the companion terminal piece 30 fit are formed in the upper surface of the connection region 31 outside the area A corresponding to the seating surface of the nut c. The rest of the construction is similar to the second embodiment.

This third embodiment has the advantage that, when the nut c is tightened, the whole of the seating surface can be pressed fast against the connection region 31 without being affected by the projections 32.

Moreover, in the embodiments described above, there may be one or three or more groups of latch-receiving parts and latch pieces, and there may also be three or more groups or projections and lock holes, or conversely only one group.

Furthermore, it is also possible to integrate three or more terminal pieces overlaid on each other by appropriately modifying the form, for example by narrowing the width of the latch-receiving part and the latch piece, and reducing the width of the barrel portion.

We claim:

1. An electrical terminal provided with a connection region which is generally aligned with a plane and has an aperture therein, and an arm to which an end of an electrical wire is connected in use, wherein the terminal is provided with angularly spaced male and female latching members formed in the connection region, the female latching member having a portion which is offset from the plane to define a gap therewith which is open on at least one radially extending side, the male latching member being receivable into the gap via the open radial side of the female latching member of an overlying second of said terminals on relative angular movement therebetween to hold the overlying connection regions together, one of said male and female latching members having a projection which engages the other of said male and female latching members of the overlying terminal to tighten the interconnection of the terminals, said connection region further including a lock projection having a generally radial locking edge extending out of the plane thereof and an angularly spaced and corresponding lock aperture having a generally radial locking side, the locking edge of the lock projection being engageable with a locking side of a lock aperture of the overlying second of said terminals to prevent a reverse relative angular movement therebetween on engagement of said latching members.

2. A terminal according to claim 1 wherein said male latching member has a tapered nose.

3. A terminal according to claim 1 wherein said lock projection is radially inward of said male latching member.

4. A terminal according to claim 1 wherein said lock projection is disposed in a clamping area of said connection region.

5. A terminal according to claim 1 wherein said lock projection is sheared outwardly from the plane of said connection region.

6. A terminal according to claim 5 wherein said projection is disposed in a clamping area of said connection region.

7. A terminal according to claim 1 wherein said male latching member extends radially outwardly from said connection region.

8. A terminal according to claim 7 wherein said female latching member is constituted by a radially outwardly extending arm of said connection region, said arm having a radially inwardly extending free end and defining a substantially C shaped opening for said male latching member.

9. A terminal according to claim 7 wherein said lock projection is sheared outwardly from the plane of said connection region.

10. A terminal according to claim 8 wherein said projection is disposed in a clamping area of said connection region.

11. A terminal according to claim 1 wherein said male latching member includes a latching projection to engage an inner wall of said offset portion of said female latching member in use.

12. A terminal according to claim 1 and which includes two male latching members and two female latching members, the male and female latching members being oppositely disposed in pairs.

13. A terminal according to claim 1 which includes two lock projections and two lock apertures, the lock projections and lock apertures being oppositely disposed in pairs.

14. A terminal according to claim 13 wherein said lock projections are radially inward of said male latching member.

15. A terminal according to claim 13 wherein said lock projections are disposed in a clamping area of said connection region.

16. An electrical terminal according to claim 1 wherein said female latching member has a generally C-shaped configuration which opens inward.

* * * * *